US009139988B2

(12) United States Patent
Lin

(10) Patent No.: US 9,139,988 B2
(45) Date of Patent: Sep. 22, 2015

(54) AERATION DEVICE

(75) Inventor: Wenjuan Lin, Far Hills, NJ (US)

(73) Assignee: AM Conservation Group, Inc., Charleston, SC (US)

( * ) Notice: Subject to any disclaimer, the term of this patent is extended or adjusted under 35 U.S.C. 154(b) by 570 days.

(21) Appl. No.: 13/501,560

(22) PCT Filed: Oct. 14, 2010

(86) PCT No.: PCT/US2010/052632

§ 371 (c)(1),
(2), (4) Date: Nov. 6, 2012

(87) PCT Pub. No.: WO2011/047134

PCT Pub. Date: Apr. 21, 2011

(65) Prior Publication Data

US 2013/0049235 A1 Feb. 28, 2013

(30) Foreign Application Priority Data

Oct. 15, 2009 (CN) ..... 2009 2 0183323 U
Oct. 15, 2009 (CN) ..... 2009 2 0183324 U
Oct. 15, 2009 (CN) ..... 2009 2 0183325 U

(51) Int. Cl.
*E03C 1/08* (2006.01)
*E03C 1/084* (2006.01)

(52) U.S. Cl.
CPC ..... *E03C 1/084* (2013.01)

(58) Field of Classification Search
CPC ..... B01F 3/04; E03C 1/084; E03C 1/086
USPC ..... 261/5, 108, 114.1
See application file for complete search history.

(56) References Cited

U.S. PATENT DOCUMENTS 3,143,299 A * 8/1964 Benjamin ..... 239/427
3,224,793 A * 12/1965 Benjamin ..... 285/8
3,286,935 A * 11/1966 Corlett et al. ..... 239/428.5

(Continued)

FOREIGN PATENT DOCUMENTS

DE 20010099 U1 * 8/2000
DE 10027986 A1 12/2001

(Continued)

OTHER PUBLICATIONS

International Search Report and Written Opinion, PCT/US2010/052632, dated Mar. 31, 2011.

*Primary Examiner* — Duane Smith
*Assistant Examiner* — Stephen Hobson
(74) *Attorney, Agent, or Firm* — Brinks Gilson & Lione

(57) ABSTRACT

Aeration devices for generating bubbles in a flow of water are disclosed including an aerator body (1), a diverter (3) including orifices (31) for receiving the flow of water, each of the orifices (31) including a decreasing pore size in the direction from the upper portion of the diverter (3*b*) towards the lower portion of the diverter (3*a*), and a lower body portion (2) including a water chamber (2*a*) for receiving and aerating the flow of water from the orifices (31) in the diverter (3). Aeration devices are also disclosed including a pressure compensator (6) mounted on the upper portion of the diverter (3*b*) for regulation of the maximum flow of water therethrough, the aerator body (1) including a ball joint opening (11) and a ball joint (12) mounted within the ball joint opening (11), the ball joint (12) comprising plastic and the upper ball joint (13) comprising metal.

10 Claims, 10 Drawing Sheets

(56) References Cited

U.S. PATENT DOCUMENTS

| | | | | |
|---|---|---|---|---|
| 4,313,564 | A * | 2/1982 | Shames et al. | 239/110 |
| 4,562,960 | A * | 1/1986 | Marty et al. | 239/72 |
| 4,573,639 | A | 3/1986 | Logue | |
| 5,071,071 | A * | 12/1991 | Chao | 239/428.5 |
| 5,143,295 | A * | 9/1992 | Okayama et al. | 239/403 |
| 7,252,248 | B2 | 8/2007 | Cutler | |
| 7,661,608 | B2 * | 2/2010 | Grether | 239/500 |
| 2005/0189289 | A1 * | 9/2005 | Hsiao | 210/456 |
| 2005/0247805 | A1 * | 11/2005 | Grether | 239/428.5 |
| 2006/0011748 | A1 * | 1/2006 | Ferrari | 239/428.5 |
| 2007/0108314 | A1 * | 5/2007 | Cutler | 239/428.5 |
| 2007/0196177 | A1 * | 8/2007 | Tasi | 405/79 |
| 2009/0166450 | A1 * | 7/2009 | Kao | 239/428.5 |
| 2010/0065661 | A1 * | 3/2010 | Grether et al. | 239/428.5 |
| 2011/0089263 | A1 * | 4/2011 | Hughett et al. | 239/428.5 |
| 2012/0061492 | A1 * | 3/2012 | Peng | 239/548 |
| 2012/0103451 | A1 * | 5/2012 | Lin | 137/833 |
| 2013/0032231 | A1 * | 2/2013 | Stein et al. | 137/561 R |
| 2013/0134239 | A1 * | 5/2013 | Blum et al. | 239/600 |
| 2014/0145013 | A1 * | 5/2014 | Blum et al. | 239/428.5 |
| 2014/0217203 | A1 * | 8/2014 | Zoller et al. | 239/428.5 |
| 2014/0300010 | A1 * | 10/2014 | Zhou | 261/78.2 |

FOREIGN PATENT DOCUMENTS

| | | | | |
|---|---|---|---|---|
| DE | 10027987 | A1 | 12/2001 | |
| DE | 102005001419 | B3 * | 5/2006 | |
| DE | 102006057795 | B3 * | 2/2008 | E03C 1/084 |
| DE | 202011108607 | U1 * | 8/2012 | |
| WO | WO 03040481 | A1 * | 5/2003 | |
| WO | WO 2004038112 | A1 * | 5/2004 | E03C 1/086 |
| WO | WO 2008065663 | A2 * | 6/2008 | B05B 1/30 |

* cited by examiner

AERATION DEVICE

CROSS-REFERENCE TO RELATED APPLICATIONS

The present application is a national phase entry under 35 U.S.C. §371 of International Application No. PCT/US2010/052632 filed Oct. 14, 2010, published in English, which claims priority from Chinese Patent Applications Nos. 200920183323.3, 200920183324.8, and 200920183325.2 filed on Oct. 15, 2009 in the Chinese Intellectual Property Office, all of which are incorporated herein by reference.

FIELD OF THE INVENTION

The present invention relates to aerators for generating bubbles in a flow of water. More particularly, the present invention relates to kitchen aerators including flow compensators which are capable of providing improved flow patterns.

BACKGROUND OF THE INVENTION

Aerator nozzles, faucets, kitchen aerators, spray heads, shower heads, and the like for controlling the fluid flow of water are well known in the art. Aerator faucets, for example, such as those for use in the kitchen, are generally complicated mechanical devices having numerous parts including water discharge heads that can be rotated to regulate the discharge spray of water from the discharge spray head. Since these types of rotating spray heads can easily break down in view of the numerous internal moving component parts therein, kitchen aerators have been improved upon. Thus, for example, in U.S. Pat. No. 7,252,248 ("the '248 Patent"), assigned to the assignee of the present application, there has been provided a kitchen aerator which includes a flow compensator for increasing the flow rate of water at low pressures and which utilizes a flip lever to regulate the water flow rate. The pressure compensator is thus capable of regulating the flow rate or maintaining the flow rate regardless of pressure variations in the stream of water. It can also ensure that the flow rate does not exceed the maximum rated flow rate for the particular device in question.

The disclosure of the '248 Patent is therefore incorporated herein by reference thereto in its entirety. In FIGS. 1 and 2 hereof, which correspond to FIGS. 3 and 3a of the '248 Patent, the kitchen aerator or faucet aerator 10 is shown in detail. These figures show this prior art device, which includes a flow compensator assembly 30, including flow compensator member 32, as well as a ball joint 36 and a pin 40 with a water flow opening 41 which is adjusted by flip lever 46. The device shown in the '248 Patent also includes a spray subassembly 60 connected to the flow compensator subassembly 30. This spray subassembly includes a chrome spray adjusting ring 80 and a rubber spray adjusting ring 82 which are used to produce either a needle spray pattern or a bubble stream (full) spray pattern by lateral movement thereof. The water out seat member 84 thereof includes water openings 85 to produce the desired spray patterns.

The search, however, has continued to improve upon these aerators and to provide superior products in terms of the materials used and the costs for producing same.

SUMMARY OF THE INVENTION

In accordance with the present invention, these and other objects have now been realized by the invention of an aerator for generating bubbles in a flow of water comprising an aerator body, a diverter having an upper portion and a lower portion attached to the aerator body, the diverter including a plurality of orifices for receiving the flow of water, each of the plurality of orifices including a decreasing pore size in a direction from the upper portion of the diverter towards the lower portion of the diverter, and a lower body portion including a water chamber having an inner surface and an outer surface for receiving and aerating the flow of water from the plurality of orifices in the diverter. In a preferred embodiment, the inner surface of the water chamber includes a plurality of baffles interrupted by a corresponding plurality of trenches therebetween for increasing the aeration of the flow of water exiting from the plurality of orifices.

In accordance with one embodiment of the aerator of the present invention, the diverter includes an upper diverter portion including the plurality of orifices and a lower diverter portion extending into the lower body portion. Preferably, the lower body portion is movable between a lower position in which the lower body portion is in sealable contact with the lower portion of the diverter, thereby preventing the flow of water from flowing therebetween, and an upper position in which the lower body portion is separated from the lower portion of the diverter thereby permitting the flow of water therebetween. In a preferred embodiment, the water chamber includes a plurality of water openings on the outer periphery thereof, whereby when the lower body portion is in the lower position the flow of water flows through the plurality of water openings, and when the lower body portion is in the upper position, the flow of water ceases through the plurality of water openings, thereby causing the flow of water to draw air through the plurality of water openings and further aerate the flow of water thereby.

In accordance with another embodiment of the aerator of the present invention, the aerator includes an inner frame surrounding the diverter and contained within the lower body portion. In a preferred embodiment, the inner frame includes an upper threaded portion, and including an upper body portion threadably affixed to the inner frame. In a preferred embodiment, the upper body portion includes an upper opening, and including a ball joint rotatably mounted within the upper opening in the upper body portion for rotatable mounting of the aerator. Preferably, the ball joint comprises a plastic ball joint.

In accordance with another embodiment of the aerator of the present invention, the aerator includes a pressure compensator mounted on the upper portion of the diverter for regulation of the maximum flow of the flow of water. Preferably, the aerator includes a screen associated with the pressure compensator for filtering the flow of water through the pressure compensator.

In accordance with the present invention, other objects have now been realized by the invention of an aerator for generating bubbles in a flow of water comprising an aerator body, a diverter having an upper portion and a lower portion attached to the aerator body, a pressure compensator mounted on the upper portion of the diverter for regulation of the maximum flow of the flow of water therethrough, the aerator body including an upper portion including a ball joint opening, and a ball joint including an upper ball joint portion including threads for connection to a faucet and a lower ball joint portion mounted within the ball joint opening for swiveling movement therein, the lower ball joint portion comprising plastic and the upper ball joint portion comprising metal. In a preferred embodiment of the aerator of the present invention, the lower ball joint portion is capable of swiveling in a 360° rotation in the ball joint opening.

In one embodiment of the aerator of the present invention, the diverter includes a plurality of orifices for receiving the flow of water. Preferably, the plurality of orifices includes a decreasing pore size in a direction from the upper portion of the diverter towards the lower portion of the diverter.

In accordance with another embodiment of the aerator of the present invention, the aerator includes a lower body portion including a water chamber having an inner surface and an outer surface for receiving and aerating the flow of water from the plurality of orifices in the diverter. Preferably the inner surface of the water chamber includes a plurality of baffles interrupted by a corresponding plurality of trenches therebetween for increasing the aeration of the flow of water exiting from the plurality of orifices.

In accordance with another embodiment of the aerator of the present invention, the diverter includes an upper diverter portion including the plurality of orifices and a lower diverter portion extending into the lower body portion. Preferably the lower body portion is movable between a lower position in which the lower body portion is in sealable contact with the lower portion of the diverter, therefore preventing the flow of water from flowing therebetween, and an upper position in which the lower body portion is separated from the lower portion of the diverter thereby permitting the flow of water therebetween. In a preferred embodiment, the water chamber includes a plurality of water openings on the outer periphery thereof, whereby when the lower body portion is in the lower position, the flow of water can flow through the plurality of water openings, and when the lower body portion is in the upper position, the flow of water ceases through the plurality of water openings, thereby causing the flow of water to draw air through the plurality of water openings and further aerate the flow of water thereby.

In accordance with another embodiment of the aerator of the present invention, the aerator includes an inner frame surrounding the diverter and contained within the lower body portion. Preferably the inner frame includes an upper threaded portion, and including an upper body portion threadably affixed to the inner frame.

In accordance with another embodiment of the aerator of the present invention, the aerator includes a screen associated with the pressure compensator for filtering the flow of water through the pressure compensator.

BRIEF DESCRIPTION OF THE DRAWINGS

The present invention may be more fully appreciated with reference to the following detailed description which in turn refers to the figures in which.

DETAILED DESCRIPTION

Figure 1:
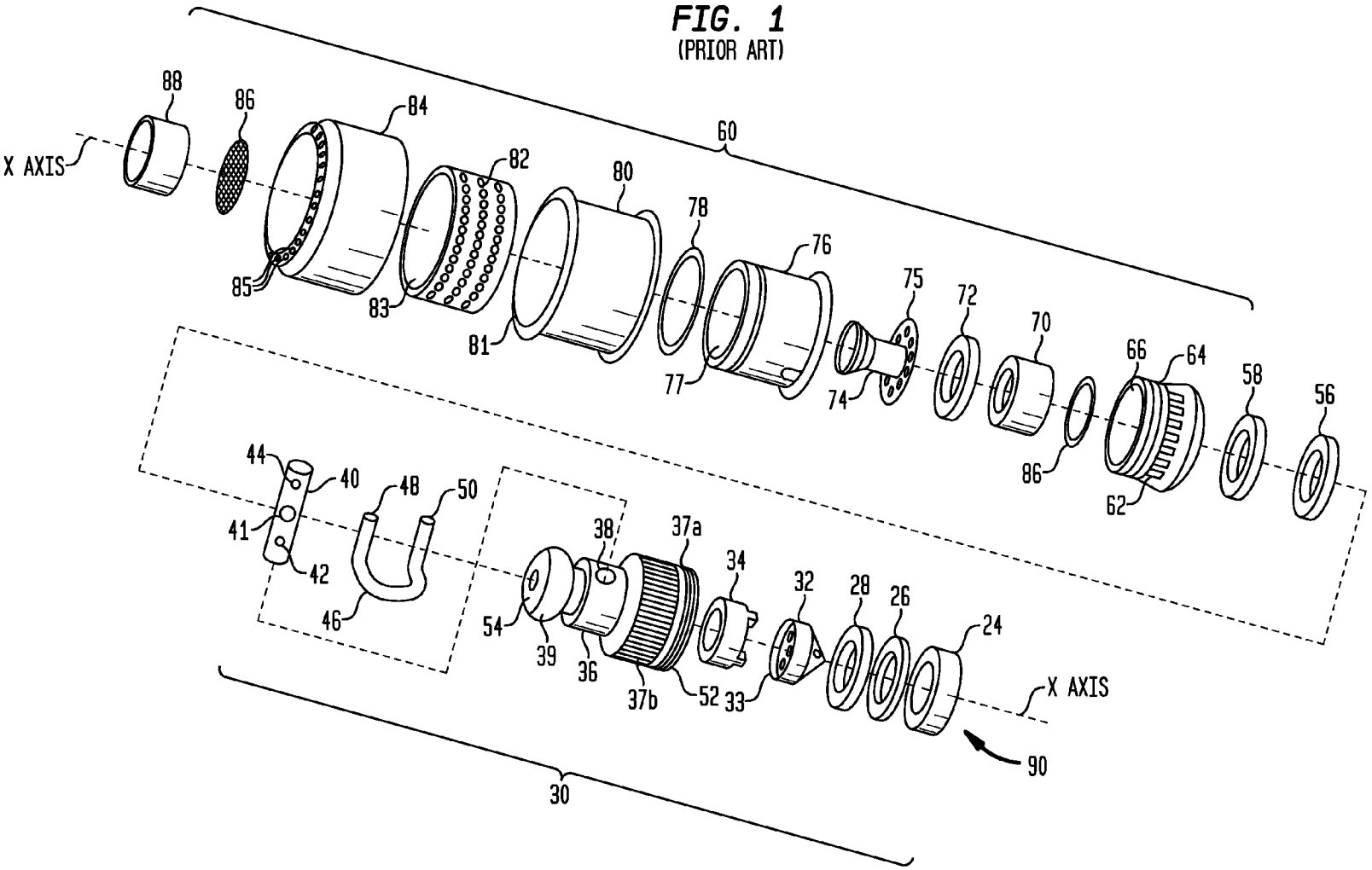
FIG. 1 (PRIOR ART)
FIG. 1 is a side, perspective exploded view of a kitchen aerator in accordance with the prior art.
Figure 2:
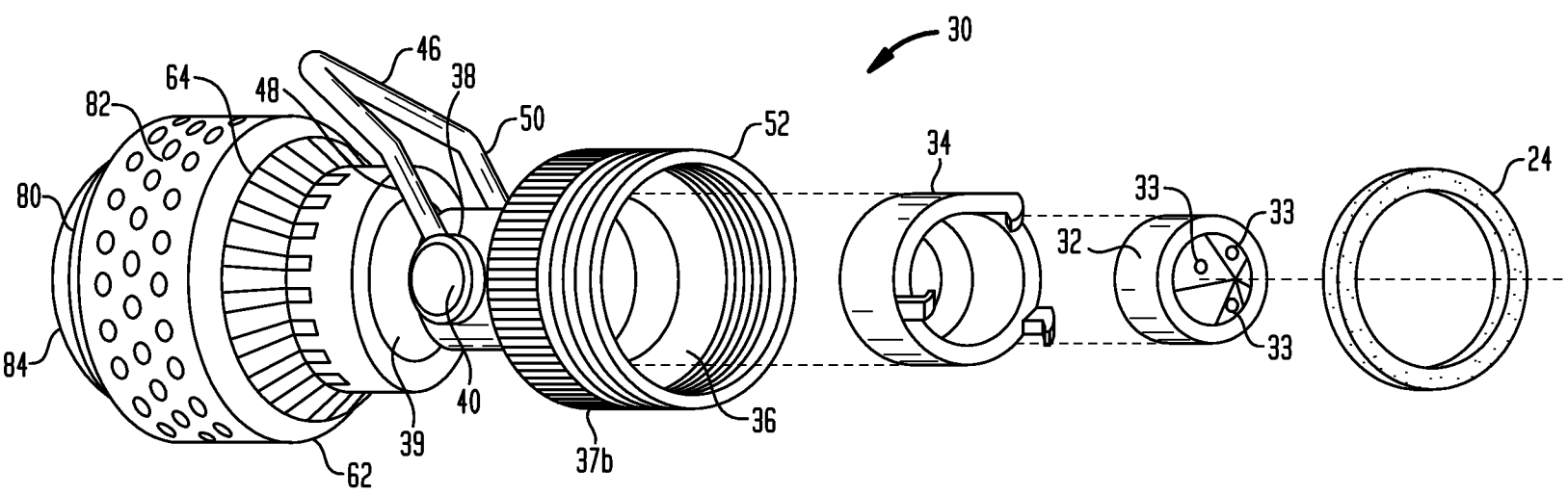
FIG. 2 (PRIOR ART)
FIG. 2 is a side, perspective, exploded view of a kitchen aerator of the prior art.
Figure 3:
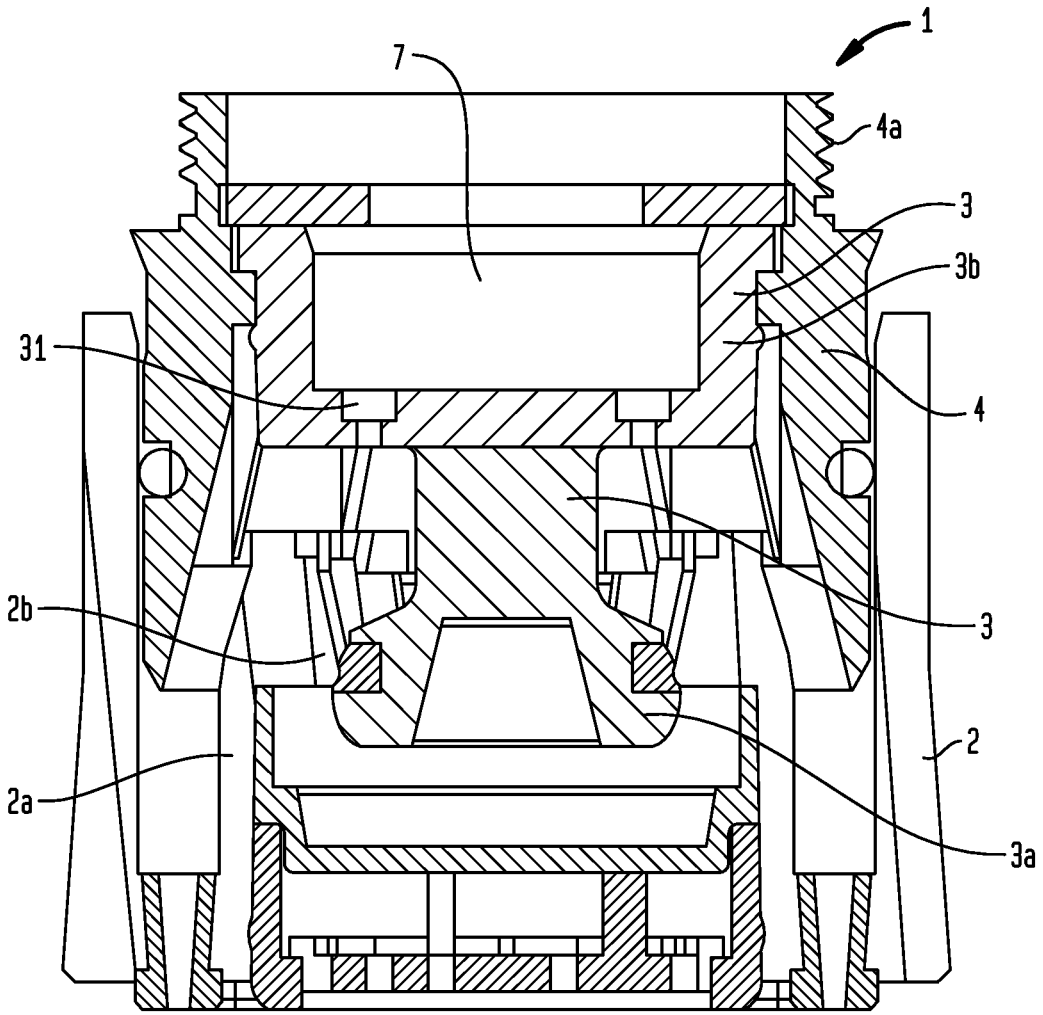
FIG. 3 is a side, elevational, sectional view of the exit portion of an aerator in accordance with the present invention.

Referring first to FIG. 3, an aerator body 1, is shown in this figure, which is intended to alternate between two positions, one of which is effective to generate a large amount of bubbles, in this case to provide softer and smoother bubble formation than has been possible in the past. The aerator body 1 has an inner frame 4 which can be attached to the upper body portion (see discussion below) by means of threads 4*a* in a manner discussed below. The inner frame 4 is attached to a lower body portion 2. This is accomplished during assembly by the inner frame 4 being pushed downwardly into the lower body portion 2. In doing so, and since the lower body portion 2 includes an O-ring 2*c* which snaps into a corresponding slot 4*c* in the outer surface of the inner base 4, not only are these two parts attached to each other, but the leakage of water is prevented through this connection. Within the inner frame 4 is contained a diverter 3 including a lower diverter portion 3*a* having an increased diameter portion at the bottom thereof, and an upper diverter portion 3*b*. Preferably, the diverter 3 is a one-piece unit including both the upper and lower diverter portions 3*b* and 3*a*, respectively. During assembly, the diverter 3 is thus pushed downwardly into the top of the inner frame 4, and is then pressed into the lower body portion 2. Since the diameter of the lower diverter portion 3*a* is slightly greater than the inner diameter of the lower body portion 2, it is necessary to force fit the diverter thereinto. Furthermore, since the diverter is preferably a one-piece unit, it is therefore able to hold these parts together by these pressure fits alone. Furthermore, as discussed in more detail below, and since the lower diverter portion 3*a* is on the lower side of the lower body portion 2, it can create an inner seal therebetween.

The upper diverter portion 3*b* is intended to equally distribute water flow throughout the entire body of the aerator body 1. The lower diverter portion 3*a*, as noted, creates a seal against the lower body portion 2, which toggles the water flow to the center bubble stream or the outer spray streams, as discussed in detail below. The diverter 3 directs the flow of water down to the lower surface of the water chamber for expulsion in the appropriate aerated manner. The upper portion of the diverter 3 includes an open mounting portion 7, and a plurality of pores 31 therebelow for the flow of water therefrom. Preferably, these pores are disposed in a circular pattern around the entire floor of the open mounting portion 7, thus distributing the flow of water as discussed above. The upper mounting portion will contain a pressure compensator (not shown in FIG. 3) as will be discussed in more detail below. These evenly distributed pores form an important element of the present invention in that they are of decreasing diameter as the water flows downwardly through them. This decreasing diameter can be step-wise, as shown in the drawings, or it can be of a continuous or semi-continuous decreasing diameter. This results in an increase in the rate of flow of the water which exits the diverter 3 as it passes through these pores 31 for aeration purposes. In the case where a two-step set of pores 31 are utilized, in a preferred embodiment the upper pores will have a diameter of about 1.2 mm, and the lower pores will then have a stepped-down diameter of about 0.6 mm. These stepped-down or reduced diameters thus create a venturi effect in which the water velocity will increase through the smaller diameter stepped portion. This, in turn, creates a much more powerful stream of water exiting from the device without changing the overall water volume itself.

Figure 4:
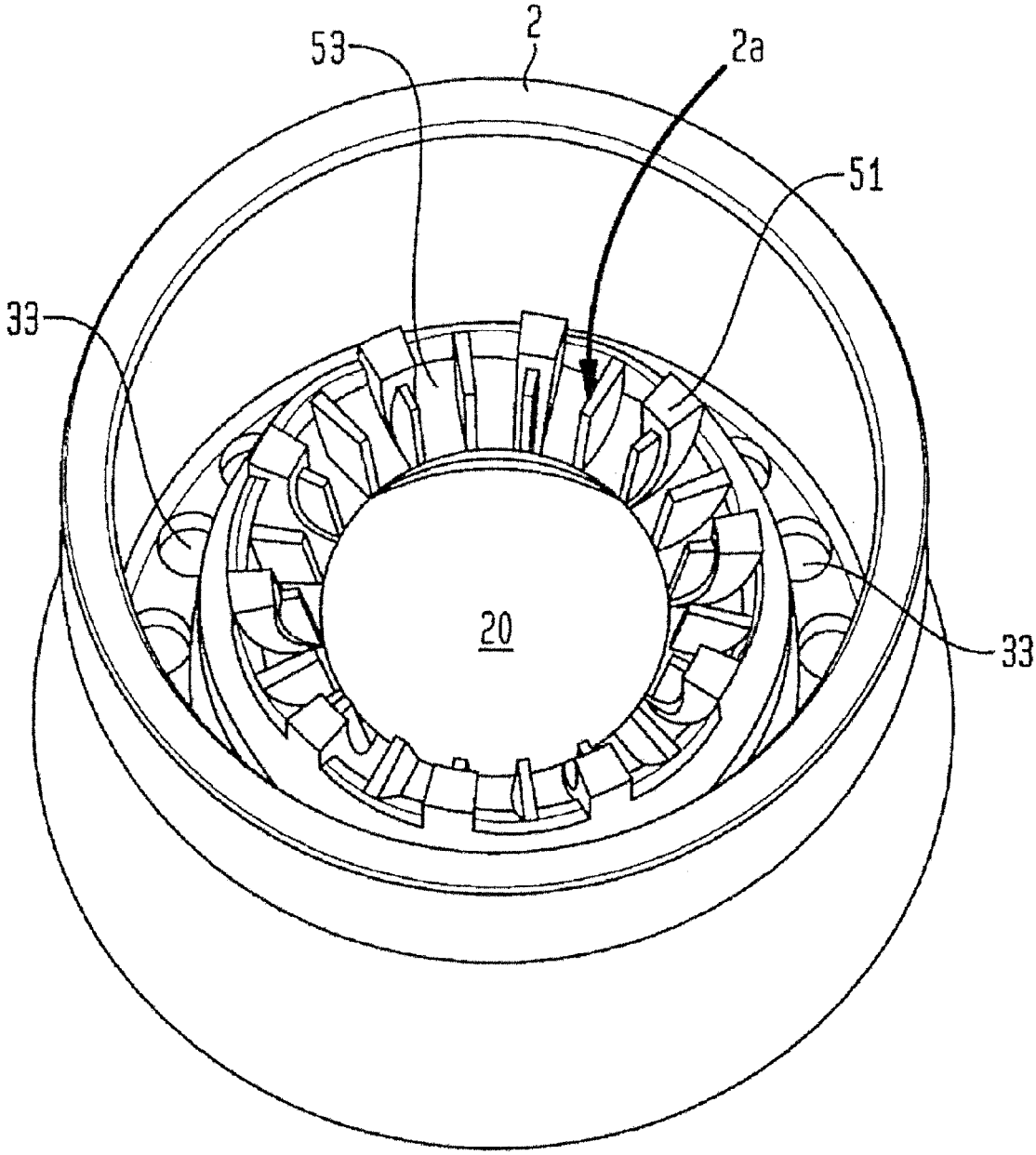
FIG. 4 is a top, perspective view of a lower body portion of the aerator shown in FIG. 3.
Figure 5:
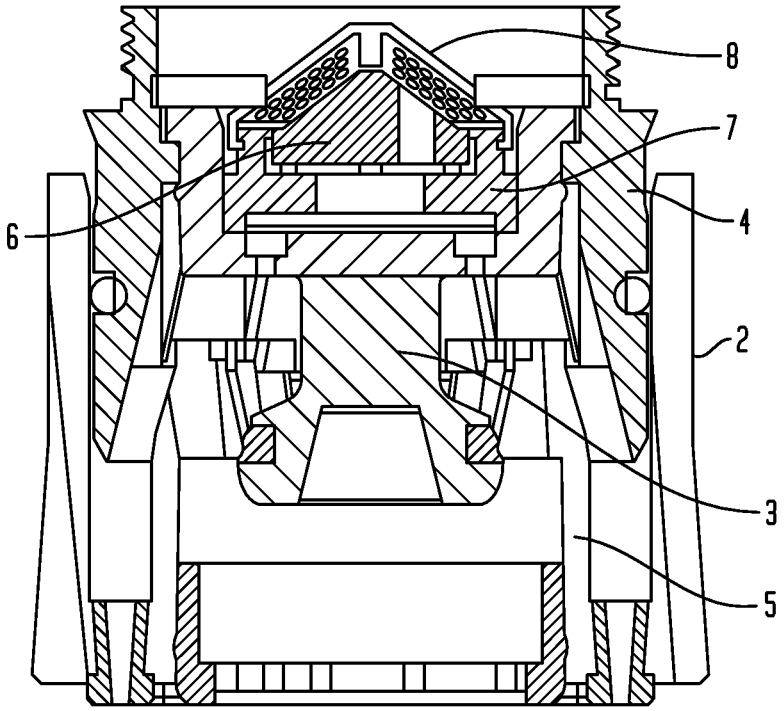
FIG. 5 is a side, elevational, sectional view of an aerator in accordance with the present invention including a pressure compensator.
Figure 6:
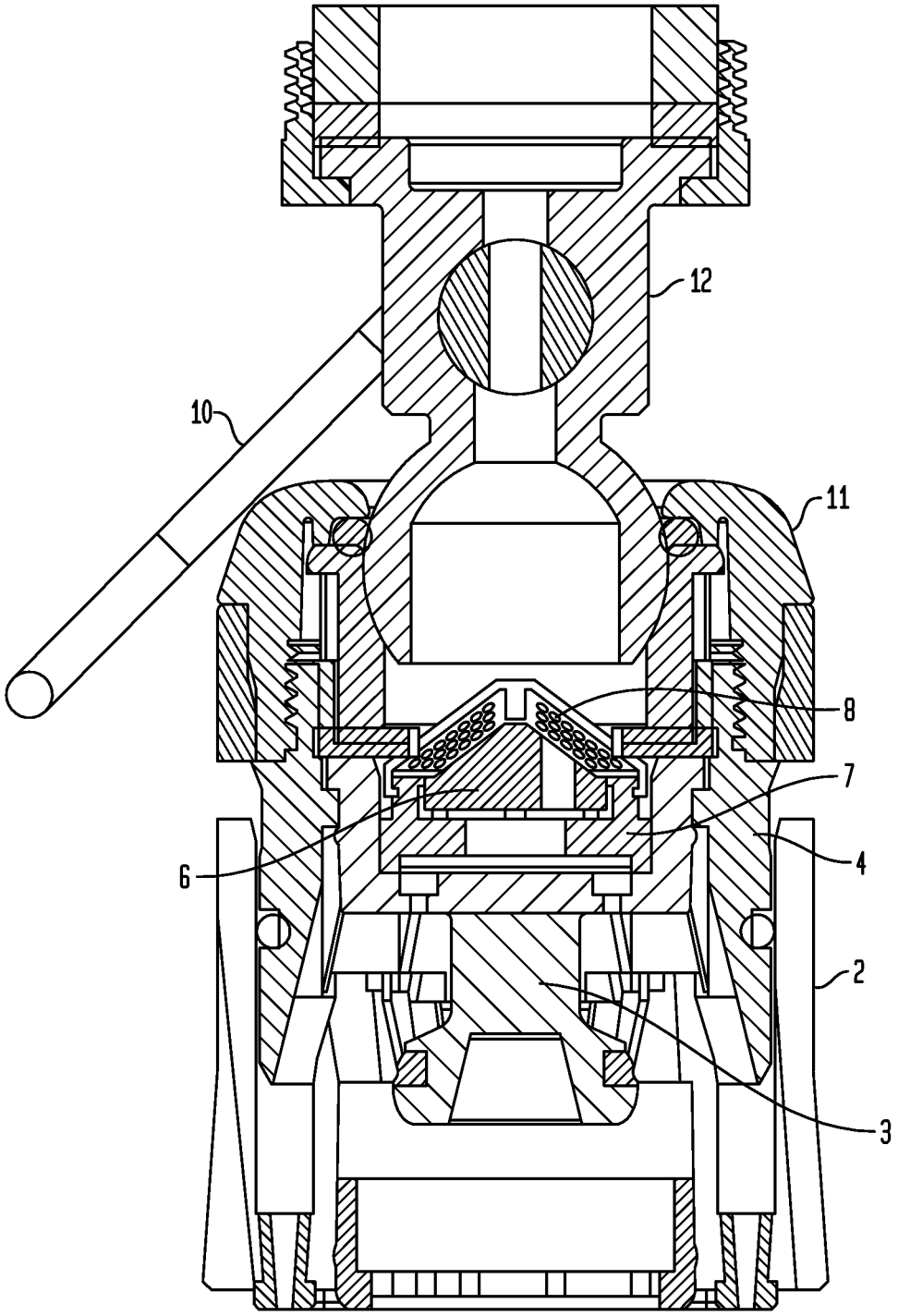
FIG. 6 is a side, elevational, sectional view of a kitchen aerator in accordance with the present invention including a ball joint attachment, and in which the lower body portion is toggled to the lower portion.
Figure 11:
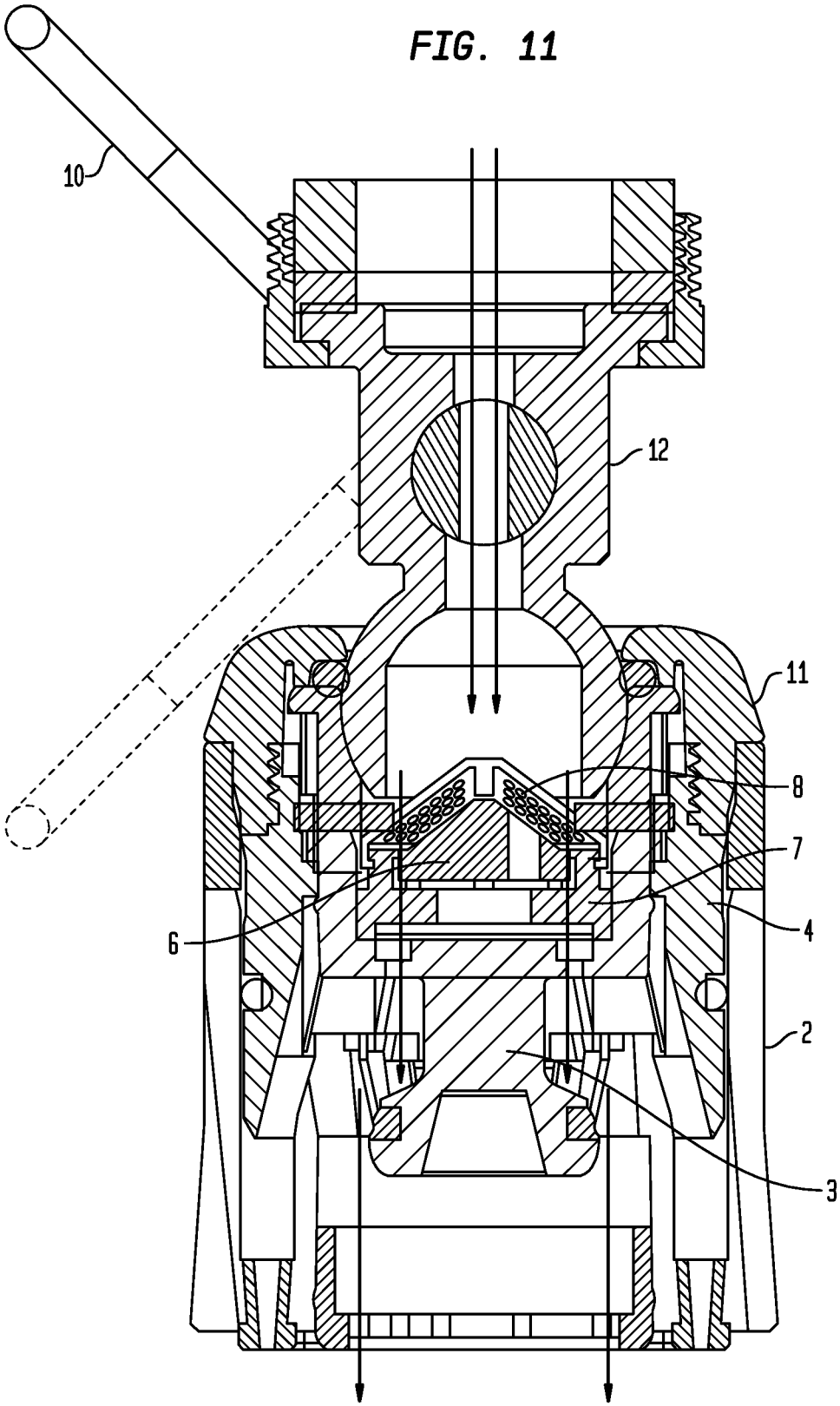
FIG. 11 is a side, elevational, sectional view of the kitchen aerator shown in FIG. 6, with the lower body portion toggled to the up position.

In the lower portion of the aerator body 1 there is disposed lower body portion 2 which is shown in FIG. 4, and which includes an inner water chamber 2*a*. The lower body portion 2, including inner water chamber 2*a*, can be toggled between two positions, an upper position, as is shown in FIG. 11, and a lower position, as is shown in FIGS. 3, 5 and 6. The user can simply slide the lower body portion 2 between these two positions by grasping its outer surface and sliding it up or down, as desired. In the down position, as in FIG. 3, a seal is created between the lower diverter portion 3*a* and the inwardly directed portion 2*b* of the inner water chamber 2*a*. This seal, in turn, prevents the water exiting the pores 31 from passing between the lower diverter portion 3*a* and the inner water chamber 2*a*, but the flow of water is thus directed radially outwardly, through a series of outlet ports 33 contained around the inner circumference of the lower body portion 2. This water flow then freely exits the aerator body 1.

On the other hand, when the lower body portion 2 is moved into an up position, as shown in FIG. 11, the seal between the lower diverter portion 3*a* and the inner water chamber 2*a* is broken, allowing the water to flow from the pores 31 directly downwardly to the central portion 2*c* of the lower body portion 2, as can be seen by the arrows in FIG. 11. The flow of water thus exits the pores 31 and impinges on the surface of the lower water chamber 2*a*. Furthermore, in this configuration, all of the water is flowing around the lower diverter portion 3*a* through the center of this device, and essentially no water is flowing through the outlet ports 33. Therefore, these outlet ports 33 leave an open channel for the movement of air. Therefore, the central flow itself will draw air from the outlet ports 33 into the aerator device, where air can then mix into the flow of water to create the increased aeration of this invention. As can also be seen in FIG. 4, along the outer periphery of the inner wall of the inner water chamber 2*a* are located a plurality of circumferential baffles 51 separated by trenches 53 therebetween. The exits for the pores 31 are thus specifically directed so that the flow of water therefrom will impinge directly onto the baffles 51, thus creating even greater aeration. In this manner, as the water rapidly exits from the decreased diameters pores 31, it is mixed with air in the manner discussed above, and it then strikes against the baffles themselves inside inner the water chamber 2*a*, thus mixing more air with the water and generating even more evenly distributed bubbles. These bubbles then flow out of the lower end 3*a* of the diverter 3 and are sprayed out from the screen at a maximum size and angular dimensions to create more desirable bubble columns therein. In this manner, the problems of disturbed effluent and insufficient bubbles which are faced in the prior art are overcome.

Figure 7:
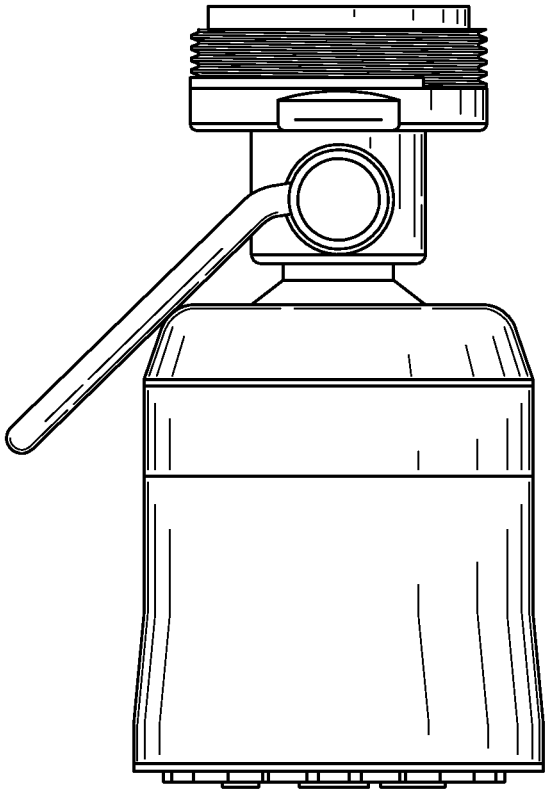
FIG. 7 is a side, elevational view of the kitchen aerator shown in FIG. 6.
Figure 8:
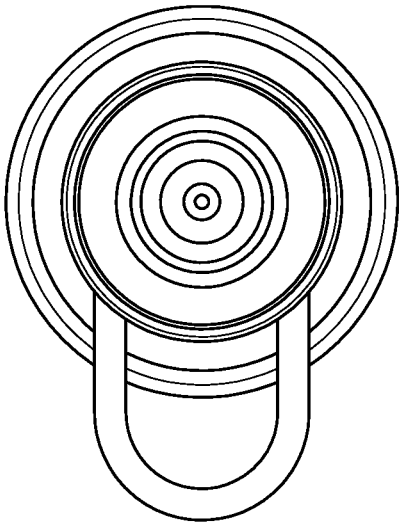
FIG. 8 is a top, elevational view of the kitchen aerator shown in FIG. 7.
Figure 9:
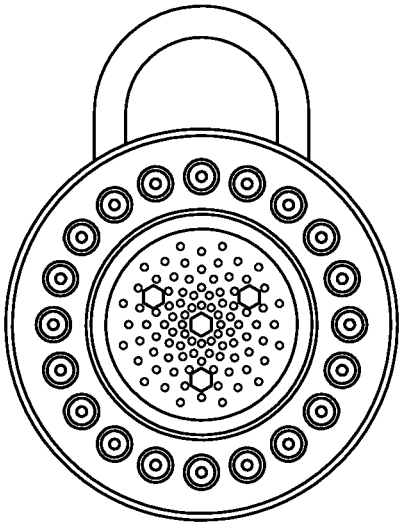
FIG. 9 is a bottom, elevational view of the kitchen aerator shown in FIG. 7.

Referring next to FIGS. 6 and 11, a dual function aerator is shown utilizing the aerator body of FIGS. 3 and 5. This device, such as that of the '248 Patent discussed above, includes a flip lever 10 for controlling the flow through the device itself. As can be seen in these figures, the aerator itself comprises an upper body portion 11 which can be affixed by corresponding threads to the inner frame 4 discussed above and as shown in FIG. 6. The upper body portion 11 is fixed to a ball joint 12, preferably for rotary movement thereabout. In this manner, the aerated water exiting from the water chamber 5 can be directed in any desired angle by the user, such as in a 360° rotation about its axis. Once again, the lower body portion 2 is fixed to the inner frame 4 in the manner discussed above, and the diverter 3 is again fixed to the inner frame 4. The inner frame 4 is bolted to the upper body portion 11 as discussed above. As shown in FIGS. 5 and 6 a pressure compensator 6 is mounted between the ball joint 12 and the diverter 3. A seat 7 is maintained within the upper portion 3*a* of the diverter 3 for mounting of the pressure compensator 6 therein. Furthermore, a conical screen 8 is mounted on top of the pressure compensator 6 for filtering the water entering the pressure compensator itself. In this manner, the screen can filter out any sediment or other debris from the flow of water itself which could create clogging in the body of the aerator. The angled conical design of this screen 8 provides increased surface area for the device and allows for a longer period of time for sediment to build up before the screen requires cleaning. This particular design as shown in FIGS. 5 and 6 includes ribs on the underside of the screen for reinforcement purposes, thus allowing it to hold its shape even in extremely high water pressure applications. As compared, for example, to the pressure compensators employed in the prior art, such as in the '248 Patent, in this case access to the pressure compensator 6 and to the screen 8 is readily obtained by merely unscrewing the upper body portion 2 from the inner frame 4. The screen 8, for example, can thus be readily cleaned. To match the conically shaped upper portion of the diverter 6, the screen 8 is also conically shaped, as shown in FIGS. 5 and 6. The overall external upper and lower views of the aerator shown in FIGS. 5 and 6 are shown in FIGS. 7, 8 and 9.

Figure 10:
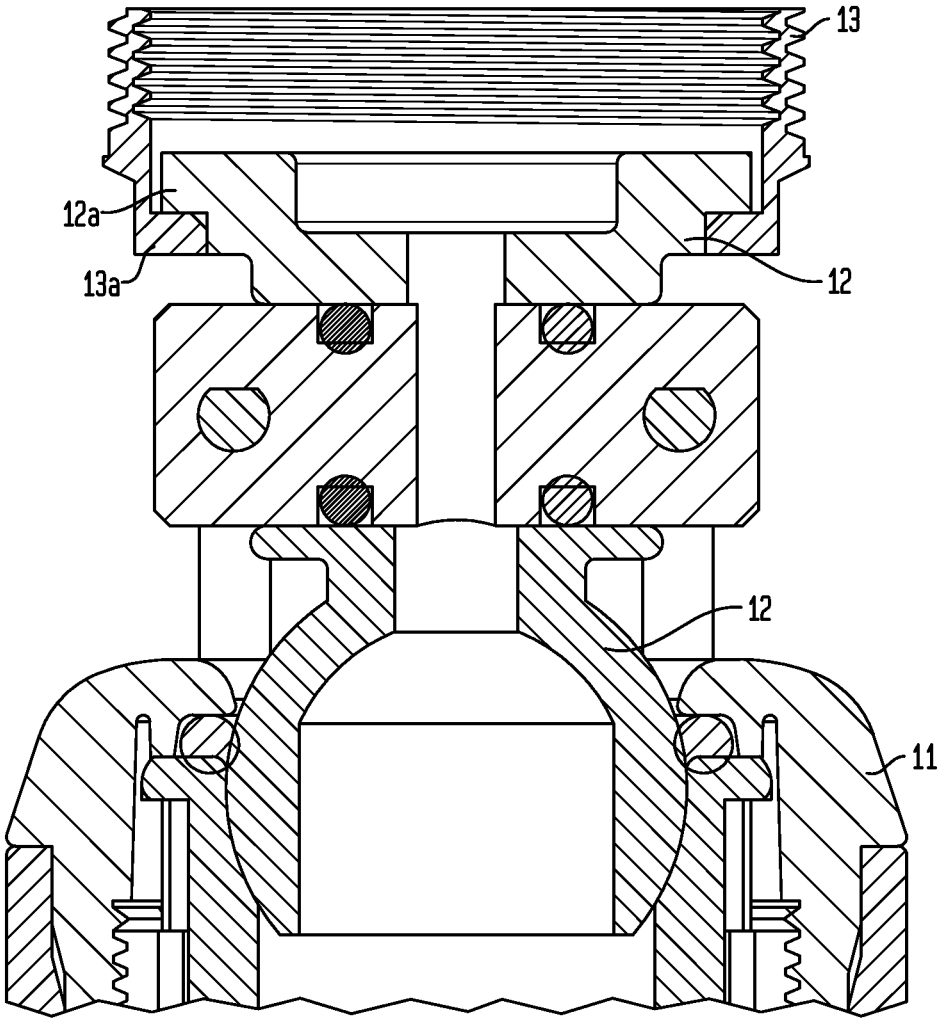
FIG. 10 is a side, elevational, partial sectional view of a portion of a kitchen aerator of the present invention including the ball joint therefor.

Turning next to FIG. 10, the upper portion of the aerator is shown, including the ball joint 12 as shown in the partial enlarged view thereof. The upper joint 13 for attachment to a kitchen tap, for example, is a copper fixture with threads as shown thereon. The body of the ball joint 12, however, is preferably made of plastic, which is attached to the copper joint 13 in the manner shown. Thus, the lower end of the copper joint 13 includes an inwardly extending flange 13*a* and the upper portion of the ball joint 2 includes an outwardly extending flange 12*a*, which is captured by the inwardly extending flange 1*a* in the manner shown therein. The body of the ball joint 2 itself is connected to the aerator 3 in the manner shown hereinabove.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

INDUSTRIAL APPLICABILITY

Aerators are provided by this invention for the aeration of water in connection with aerator nozzles, faucets, kitchen aerators, spray heads, shower heads, and the like. The aerators can include adjustable flow control mechanisms for altering the flow through the aerator, and for producing greater aeration in one mode as compared to another, thus providing aerated water flow for each of these devices.

The invention claimed is:

1. An aerator for generating bubbles in a flow of water comprising an aerator body, a diverter having an upper portion and a lower portion attached to said aerator body, said diverter including a plurality of orifices for receiving said flow of water, each of said plurality of orifices including a decreasing pore size in a direction from said upper portion of said diverter towards said lower portion of said diverter, and a lower body portion including a water chamber having an inner surface and an outer surface for receiving and aerating said flow of water from said plurality of orifices in said diverter, wherein said inner surface of said water chamber includes a plurality of baffles interrupted by a corresponding plurality of trenches therebetween, said plurality of baffles and said plurality of trenches curved inward in the distal direction, and wherein said plurality of baffles are configured to strike said flow of water exiting from said plurality of orifices to increase the aeration of said flow of water.

2. The aerator of claim 1 wherein said diverter includes an upper diverter portion including said plurality of orifices and a lower diverter portion extending into said lower body portion.

3. The aerator of claim 2 wherein said lower body portion is movable between a lower position in which said lower body portion is in sealable contact with said lower portion of said diverter, therefore preventing said flow of water from flowing therebetween, and an upper position in which said lower body portion is separated from said lower portion of said diverter thereby permitting said flow of water therebetween.

4. The aerator of claim 3 wherein said water chamber includes a plurality of water openings on the outer periphery thereof, whereby when said lower body portion is in said lower position, said flow of water flows through said plurality of water openings, and when said lower body portion is in said upper position, said flow of water ceases through said plurality of water openings, thereby causing said flow of water to draw air through said plurality of water openings and further aerate said flow of water thereby.

5. The aerator of claim 1 including an inner frame surrounding said diverter and contained within said lower body portion.

6. The aerator of claim 5 wherein said inner frame includes an upper threaded portion, and including an upper body portion threadably affixed to said inner frame.

7. The aerator of claim 6 wherein said upper body portion includes an upper opening, and including a ball joint rotatably mounted within said upper opening in said upper body portion for rotatable mounting of said aerator.

8. The aerator of claim 7 wherein said ball joint comprises a plastic ball joint.

9. The aerator of claim 1 including a pressure compensator mounted on said upper portion of said diverter for regulation of the maximum flow of said flow of water.

10. The aerator of claim 9 including a screen associated with said pressure compensator for filtering said flow of water through said pressure compensator.

* * * * *